United States Patent [19]

Takeda et al.

[11] 4,121,938

[45] Oct. 24, 1978

[54] PHOTOGRAPHIC MATERIAL CONTAINING $TiO_2$, SOLUBLE CU(II) SALT, AND SOLUBLE SILVER SALT AND THE USE THEREOF IN PHYSICAL DEVELOPMENT

[75] Inventors: Keiji Takeda; Kenji Matsumoto, both of Asaka, Japan

[73] Assignee: Fuji Photo Film Co., Ltd., Minami Ashigara, Japan

[21] Appl. No.: 813,739

[22] Filed: Jul. 7, 1977

[30] Foreign Application Priority Data

Jul. 7, 1976 [JP] Japan ..... 51-81139

[51] Int. Cl.[2] ..... G03C 1/00; G03C 5/24

[52] U.S. Cl. ..... 96/48 PD; 96/88

[58] Field of Search ..... 96/48 PD, 88

[56] References Cited

U.S. PATENT DOCUMENTS

| | | | |
|---|---|---|---|
| 3,512,972 | 5/1970 | Case | 96/48 PD |
| 3,634,083 | 1/1972 | Berman et al. | 96/48 PD |
| 3,655,383 | 4/1972 | Shepard et al. | 96/48 PD |
| 3,663,225 | 5/1972 | McLeod | 96/48 PD |
| 3,674,489 | 7/1972 | Wyman | 96/48 PD |
| 3,839,038 | 10/1974 | Gracia et al. | 96/48 PD |

*Primary Examiner*—Won H. Louie, Jr.

*Attorney, Agent, or Firm*—Sughrue, Rothwell, Mion, Zinn and Macpeak

[57] ABSTRACT

A photographic material comprising a support having thereon a light-sensitive layer containing powdered titanium dioxide, a soluble silver salt, a soluble copper (II) salt and a hydrophilic binder and a method of forming a black copper image comprising dipping the imagewise exposed photographic material into an aqueous solution containing a reducing agent.

13 Claims, No Drawings

PHOTOGRAPHIC MATERIAL CONTAINING $TiO_2$, SOLUBLE CU(II) SALT, AND SOLUBLE SILVER SALT AND THE USE THEREOF IN PHYSICAL DEVELOPMENT

BACKGROUND OF THE INVENTION

1. Field of the Invention

The present invention relates to a photographic material and a method of forming images using the same. More particularly, the present invention relates to a novel photographic material in which titanium dioxide is used as a light-sensitive component and a copper (II) salt is used as an image-forming material, and to a method of forming images using the same.

2. Description of the Prior Art

Silver halide photographic processes and silver halide diffusion transfer processes have been widely used as high speed photographic processes. Known fairly high speed photographic processes include photographic processes for obtaining images by thermal development using a long-chained fatty acid as an image-forming material ("Dry Silver", trade name, produced by Minnesota Mining and Manufacturing Co.) as disclosed, for example, in U.S. Pat. Nos. 3,152,903, 3,152,904 and 3,457,075, photographic processes for obtaining silver images by silver ion physical development using titanium dioxide as a light-sensitive component (the "RS Process" of Itek Co.) as described, for example, in G. L. Mcleod, *Photographic Science and Engineering,* 13 93 (1969) and E. Berman, ibid., 13 50 (1969), photographic processes for obtaining silver images by silver ion physical development using a diazonium compound as a light-sensitive component ("PD Process" of the Philips Co.) as described, for example, in H. Jonker et al., *Photographic Science and Engineering,* 13 1 (1969); ibid., 13 33 (1969); ibid., 13 38 (1969); ibid., 13 45 (1969); and *J. Photographic Science,* 19 96 (1971), and the like. Each of these photographic processes has their own characteristic features as to sensitivity, image quality, rapid processing, dry processing, shelf life, resolving power, or the like. However, they generally require the use of large amounts of silver since silver compounds are employed therein as a light-sensitive or image-forming material (or, in the case of silver halide color photographic processes, as an intermediate medium for forming color images). This not only makes them expensive since recovery and reuse of silver are practiced only in some of them on account of facilities, etc., but can be a fatal disadvantage in them since there is a fear that silver resources may become exhausted.

Therefore, development of a photographic process using silver in a reduced amount or a photographic process not using silver, i.e., so-called non-silver photographic process is desired. Although many non-silver photographic processes are known and they are too numerous to enumerate here, they are generally inferior in sensitivity to photographic processes using silver. Known photographic processes for producing images of non-silver metals using as a light-sensitive component or development nucleus-forming material a small amount of silver compounds or non-silver compounds include physical development processes employing non-silver metal ions, such as those described, for example, in U.S. Pat. Nos. 3,512,972, 3,893,857, 2,609,295, 2,733,144, 2,738,272, 2,750,292, 2,763,484 and 3,775,773; H. Jonker et al.,

*Photographic Science and Engineering,* Vol. 13, p. 1 (1969); ibid., Vol. 13, p. 33 (1969); ibid., Vol. 13, p. 38 (1969); ibid., Vol. 13, p. 45 (1969); and H. Jonker et al., *Journal of Photographic Science,* Vol. 19, p. 96 (1971). In these non-silver metal physical development processes, the processing steps involve amplification of images to a considerable extent so that images and formed at fairly high sensitivities, but they suffer from such disadvantages that reducible metal ions, which are the image-forming material, generally tend to be reduced by reducing agents present simultaneously in developing solutions, fog tends to be generated on the images, the loss of metal ions is not limited to small quantities thereof, and waste developing solutions tend to cause deleterious environmental pollution problems since they contain ions of heavy metals.

It has long been known that photoconductive (or semiconductive) materials, such as titanium dioxide, etc., when exposed to actinic light, are capable of reducing various kinds of materials having strong oxidative properties, such as metal ions (e.g., silver salts), to reduced forms thereof, and photographic processes applying the phenomenon have been proposed, for example, in U.S. Pat. Nos. 3,700,447, 3,414,410, 3,390,989, 3,424,582, 3,512,972, 3,711,282, 3,380,823, 3,623,865, 3,547,635, 3,713,823, 3,674,489, 3,893,857 and 3,706,560; G. L. McLeod, *Photographic Science and Engineering,* Vol. 13, P. 93 (1969); E. Berman, ibid., Vol. 13, p. 50 (1969) and E. J. Delorenzo et al., ibid., Vol. 13, p. 95 (1969). Of these processes, the one employing silver physical development has been put to practical use as the "RS Process" described hereinbefore.

These photograhic processes, however, also unavoidably suffer from the above-described defects in stability of the physical development solutions, fogging, loss of metal ions, pollution problems caused by waste developing solutions, etc., since in these processes images are formed by immersing the light-sensitive layer containing a photoconductive material into a so-called physical development solution containing both ions of a metal (such as silver, copper, tin, etc.), which is the image-forming material, and a reducing agent (or by successively immersing the light-sensitive layer into a solution of a metal ion and then into a solution of a reducing agent) after imagewise exposure thereof.

Photographic materials having a light-sensitive layer containing an oxidizing agent such as a metal ion, etc., in combination with a photoconductive material, and image-forming processes using the same have also been proposed. U.S. Pat. No. 3,052,541 and Japanese Patent Applications (OPI) 122,325/74 and 18,531/76 disclose photographic materials containing a silver salt and a photoconductive material. U.S. Pat. Nos. 3,718,465, 3,661,587 and 3,152,903 disclose, as examples of oxidizing agents to be incorporated into light-sensitive layers in combination with a photoconductive material, non-silver metal salts such as copper salts, as well as silver salts. However, silver salts are chiefly employed therein. These photographic materials containing metal ions are capable of forming images of metals generated by the reduction of the metal ions (so-called print out images) directly by exposure or by a modified processing.

These photographic materials, which contain simultaneously a photoconductive material and an oxidizing agent, such as metal ions, have to be subjected to a fixing since they generally form print out images directly by exposure, and can hardly be a high speed photographic material because, in general, no amplification step is involved therein.

SUMMARY OF THE INVENTION

After analyzing and considering the advantages and disadvantages of the above-described known photographic processes, extensive studies have been conducted, and, as a result, it has now been found that when a small amount of fine colloidal silver (e.g., evaporated silver) is applied in an imagewise manner onto a hydrophilic colloid layer in which a copper (II) salt is dispersed (at this stage, the layer is merely colored a light yellowish brown color) and the layer is treated with an aqueous solution containing a reducing agent (hereinafter referred to as a "chemical development solution" wherein the term "chemical" is used in order to distinguish the developing solution from so-called physical development solutions, which simultaneously contain both reducing agents and metal ions for forming images, and not to define the mechanism of the development), only those areas in which the colloidal silver is present are colored a black color to form a black image corresponding to the silver image. It is apparent that the above black material is not generated from the metallic silver, but from the copper salt since no coloration is observed when a layer prepared in the same manner as the above one, except no copper salt is incorporated therein, is processed in the same manner as above. The black material has been proved by chemical analysis to be copper (II) oxide or a mixture of copper (II) oxide and metallic copper. (The black image is hereinafter referred to simply as a copper image.) That is to say, the copper salt is converted into the black copper image in an amplifying manner.

Basically, the present invention is based on the discovery of the novel and surprising phenomenon described above, i.e., a novel method of visualizing an image in an amplifying manner, and has been achieved by applying the same.

A first object of the invention is to provide a photographic process capable of forming non-silver images at a high speed by using quite a small amount of a silver compound.

A second object of the invention is to provide a photographic process free from the disadvantages accompanying physical development (e.g., lack of stability of developing solutions, pollution problems caused by discharge of waste developing solutions, etc.) in which the formation of a non-silver image is not effected by physical development using non-silver metal ions, but by chemical development by the use of a light-sensitive material containing a copper compound as an image-forming material.

A third object of the invention is to provide a photographic process using silver in an extremely reduced amount in which silver nuclei acting as developing nuclei for forming a non-silver image are not generated by the photolysis of a light-sensitive silver halide compound, but by the interaction between a silver compound and a photoconductive material used as a light-sensitive component.

The photographic material of the invention comprises a support having coated thereon a light-sensitive layer containing (a) powdered titanium dioxide, (b) a soluble silver salt, (c) a soluble copper (II) salt and (d) a hydrophilic colloid.

DETAILED DESCRIPTION OF THE INVENTION

The present invention provides an image-forming process comprising the generation of fine silver particles (hereinafter referred to as "silver development nuclei" or simply as "silver nuclei") which act as a catalyst for the above-described reaction for forming a copper image in an amplifying manner by means of photolysis of a silver salt adsorbed on titanium dioxide (or present in the vicinity of the titanium dioxide) and the formation of a copper image by means of the above-described visualization of the image in an amplifying manner, and with a photographic material used therefor.

In the process of the invention, only a latent image or, at most, a very thin visible print out image is formed in the light-sensitive layer upon exposure and no dense image is formed until it is subjected to development. Accordingly, fixing of the photographic material of the invention is not required in contrast with the above-described photographic materials, and it is possible to record images at a higher speed since an amplification process is involved in the development thereof. No known reports, including the above-described patent specifications, have described such a photographic process in which two functions—the generation of developing nuclei by means of exposure and the visualization of a non-silver metal image in an amplifying manner by these nuclei—can be achieved in a single layer. In addition, in the photographic materials described in U.S. Pat. No. 3,152,903 set forth above, the photoconductive material and the metal ion must be present in different layers, while in the photographic material of this invention both of the silver and copper salts are present in a single layer. It will be apparent that the present invention is superior in this point, too.

The photographic material, if the soluble copper (II) salt is not present, will, upon exposure, generally form a yellowish brown print out image consisting of silver atoms. Photographic processes which utilize such an image per se as a final image are already known from the above-described patent specifications. In the photographic material of the invention, however, the amount of the soluble silver salt to be incorporated into the light-sensitive layer is only about 0.1 to about 0.001 g (as metallic silver) per $m^2$ of the material, which is extremely small compared with the amount used in prior photographic materials, and, therefore, the density of the actual print out image consisting of silver atoms alone is very low. However, where a soluble copper (II) salt is present in the light-sensitive layer, the very low optical density silver image can be intensified to a black copper image of a sufficient optical density by immersion thereof into an aqueous solution containing a reducing agent described hereinafter (a chemical development solution), so that basically a non-silver image can be ultimately obtained. On the other hand, where the soluble silver salt alone is removed from the light-sensitive layer, no image can be obtained. It is, therefore, apparent that silver nuclei generated from the soluble salt of silver play an indispensable part in the photographic process of the invention. That is, neither development nuclei nor a copper image can be produced directly from the soluble copper (II) salt even in the presence of photoexcited titanium dioxide. In addition, no image is formed also where the powdered titanium dioxide alone is removed from the light-sensitive layer.

It is, therefore, apparent that the powdered titanium dioxide only functions as a light-sensitive component (or photosensor) in the light-sensitive material of the invention. The above facts will become apparent from the comparative examples described hereinafter.

Accordingly, a hitherto unknown image-forming process is provided by the invention, which comprises image-wise exposing powdered titanium dioxide to excite the titanium dioxide through absorption of light, generating of silver nuclei resulting from the reduction of a soluble silver salt by free or captured electrons produced by the excitation, and forming a black copper image through selective reduction of a soluble copper (II) salt contained in the light-sensitive layer to copper atoms (and further oxidation thereof to copper (II) oxide) based on the catalytic action of the silver nuclei in a chemical development solution.

Thus, the light-sensitive material of the invention contains a copper (II) salt which serves as an image-forming material in the light-sensitive layer thereof, that is, it is a so-called "internal type" light-sensitive material and is free from all of the above-described disadvantages involved in prior physical development processes of the so-called "external type" in which image-forming metal ions are supplied externally to the light-sensitive layer (i.e., from a so-called "physical developer"). Also with the light-sensitive material, the copper image obtained in the invention is black, whereas copper images obtained by prior external physical development processes are red.

The fact that the content of the soluble silver salt ranges from about 0.1 g to about 0.001 g (as metallic silver) per $m^2$ of the photographic material is of great importance to the invention. This indicates that the soluble silver salt is not used as an image-forming material, but rather as a precursor of a catalyst for forming copper images, so that the amount can be quite small, compared with prior photographic materials using silver compounds as an image-forming material, such as silver halide photographic materials, thermally developable light-sensitive materials based on organic silver salts and the above-described photographic materials comprising both photoconductive materials and silver compounds; for example, as described in U.S. Pat. Nos. 3,052,541, 3,718,465, 3,661,587 and 3,152,903, and Japanese Patent Applications (OPI) 122,325/74 and 18,531/76. It is more important that the upper limit of the amount of silver is not decided arbitrarily in order to conserve silver, but rather determined based on the requirement for controlling the generation of silver fog nuclei within an allowable limit. That is, if an excess of the soluble silver salt is present in the light-sensitive layer, it may, upon immersion into a chemical developer, be reduced by the reducing agent present in the chemical developer, resulting in the formation of metallic silver (or fog nuclei) which acts, like silver nuclei generated in an imagewise manner in the exposed areas thereof, as a catalyst for transforming the copper salt into copper oxide or metallic copper to produce a black fog in the unexposed areas thereof. The lower limit of the silver amount is fixed by the density of silver nuclei required to provide a sufficient density to the copper images.

The powdered titanium dioxide used in the light-sensitive material of the invention may be either rutile or anatase type, and the particle size thereof is not particularly limited. Preferably, however, titanium dioxide powders having a mean particle size of from about 0.05 μm to about 7 μm are employed in order to provide a good resolving power to the images obtained. The powdered titanium dioxide is preferably incorporated into the light-sensitive layer in an amount of from about 0.5 g to about 50 g, more preferably from 2 g to 30 g per $m^2$ of the light-sensitive layer.

The term "soluble silver salt" is used herein to describe a silver salt which is soluble to an extent of at least about 10 mg in 100 ml of water or a polar organic solvent, such as N,N-dimethylformamide, methanol, ethanol, etc. Suitable silver salts can be selected from silver salts of inorganic acids (such as silver salts of sulfuric acid, thiosulfuric acid, nitric acid, nitrous acid, perchloric acid, perbromic acid, periodic acid, hypochlorous acid, hypobromous acid, hypoiodous acid, hydrofluoric acid and the like) and silver salts or organic acids. Specific examples of useful silver salts of inorganic acids include silver nitrate, silver nitrite, silver chlorate, silver bromate, silver perchlorate, silver perbromate, silver (I) fluoride, silver sulfate, and the like. Suitable examples of useful silver salts of organic acids include silver citrate, silver acetate, silver lactate, silver benzoate, etc. The amount of these silver salts in the light-sensitive layer is as described hereinbefore.

The term "soluble copper (II) salt" is used herein to describe a copper (II) salt which is soluble to an extent of at least about 0.1 g in 100 ml of water or a polar organic solvent, such as N,N-dimethylformamide, methanol, ethanol, isopropanol, dioxane, etc. Soluble copper (II) salts can be selected from the following types of compounds: copper (II) salts of inorganic acids, such as copper nitrate, copper nitrite, copper sulfite, copper chlorate, copper bromate, copper perchlorate and copper perbromate; and salts of copper (II) and organic carboxylic acids represented by the following general formula:

$$R\text{-}(COOH)_n \qquad (I)$$

wherein R represents a hydrogen atom; a straight-chained, branched-chained or cyclic unsubstituted alkyl group having 1 to 17 carbon atoms which may contain 1 to 5 double bonds, (e.g., methyl, ethyl, propyl, isopropyl, butyl, sec-butyl tert-butyl, pentyl, isoamyl, hexyl, heptyl, nonyl, capryl, myristyl, oleyl and the like), or derivatives thereof substituted with a hydroxyl group, a chlorine atom, a bromine atom, a methoxy group, an ethoxy group, etc.; a substituted or unsubstituted aryl group having 1 to 3 aromatic rings, e.g., phenyl, naphthyl, anthryl, etc., in which the substituent on the aryl moiety may be one or more of an alkyl or alkoxyl group having 1 to 5 carbon atoms, an amino group (e.g., amino, methylamino, ethylamino, dimethylamino, diethylamino, etc.), an aralkyl group having 7 to 20 carbon atoms and containing 1 to 2 aromatic rings (e.g., benzyl, phenethyl, 2-naphthylmethyl, etc.), a halogen atoms (e.g., fluorine, chlorine, bromine, iodine, etc.), an acetyl group, a hydroxyl group or a cyano group (e.g., phenyl, naphthyl, anthryl and derivatives thereof substituted with a hydroxyl group, a chlorine atom, a bromine atom or a methoxy group); and $n$ represents an integer of from 1 to 6.

Specific examples of such organic carboxylic acid salts include copper formate, copper acetate, copper caproate, copper myristate, copper stearate, copper oleate, copper citrate, copper gluconate, copper tartrate, copper succinate, copper benzoate, copper salicylate, and the like. Of these copper salts, copper nitrate is particularly suitable. The amount of the copper (II) salt in the light-sensitive layer preferably ranges from about 0.05 g to about 5 g, more preferably from 0.1 g to 5 g (as metallic copper), per $m^2$ of the photographic material.

Suitable hydrophilic binders which may be used include naturally-occurring, semi-synthetic or synthetic high molecular weight compounds which may be either water-soluble or water-permeable. Specific examples of useful hydrophilic binders include proteins or protein derivatives, such as gelatin, albumin, casein, etc.; cellulose derivatives, such as carboxymethyl cellulose, hydroxymethyl cellulose, cellulose acetate (acetylation degree of about 45% to 55%); etc.; agaragar; sodium alginate; starch derivatives; and synthetic polymers, such as poly(vinyl alcohol), poly(vinyl pyrrolidone), homo- or co-polymers of acrylic acid or the salts thereof, polyacrylamide, poly(vinyl pyridine), etc. These binders can be used either individually or in the form of a mixture of two or more mutually compatible compounds. The binders preferably have a molecular weight of from about 5,000 to about 500,000. A suitable amount of these binders in the light-sensitive layer preferably ranges from about 0.5 g to about 100 g, more preferably from 1 g to 20 g, per $m^2$ of the light-sensitive layer.

Suitable supports which can be used include various kinds of sheets, films or plates to which the above-described binder layers can adhere strongly. Examples of useful supports include naturally-occurring, semi-synthetic or synthetic polymers (e.g., poly(ethylene terephthalate), polyimides, nylon, triacetyl cellulose, etc.), paper, synthetic paper, cloth, leather, synthetic leather, wood plates, glass plates, and the like. The thickness of the support can be determined arbitrarily depending on the use and purpose thereof, but a suitable thickness is ordinarily from about 10 μm to about 2 mm, preferably from 20 μm to about 200 μm.

The light-sensitive layer in the photographic material of the invention can also contain a variety of dyes as a spectral sensitizer for the titanium dioxide. As to the types and amounts of sensitizing dyes which can be employed, reference may be made to the disclosure in U.S. Pat. No. 3,666,464, and R.H. Sprague and J.H. Keller, *Photographic Science and Engineering,* Vol. 14, p. 401 (1970).

The photographic material of the invention can be prepared by various methods. In one method, a silver salt is adsorbed on the surface of powdered titanium dioxide by adding a solution of a soluble silver salt to a dispersion of powdered titanium dioxide or conversely by dispersing powdered titanium dioxide into a solution of a soluble silver salt (the dispersion medium and solvent used in these dispersions or solutions, of course, must be a solvent capable of dissolving the silver salt), and the resulting powder is separated and washed with the same solvent to remove excess silver salt. The thus obtained powdered titanium dioxide having the silver salt adsorbed thereon is then dispersed into a solution of a soluble copper (II) salt and a hydrophilic binder, and the resulting dispersion is coated on a support and dried.

In another method, powdered titanium dioxide, a soluble silver salt, a soluble copper (II) salt and a binder are dispersed or dissolved directly in a solvent capable of dissolving the last three components, and the resulting dispersion or solution is coated on a support and then dried. In this method, the order of addition of the components into the solvent is not particularly limited, but the titanium dioxide, the silver salt and the copper (II) salt are preferably dissolved or dispersed in this order into a solvent or a solution of a hydrophilic binder.

In still another method of preparing the light-sensitive material of the invention, a layer containing powdered titanium dioxide, a soluble copper (II) salt and a hydrophilic colloid is applied on a support and then the coated support is immersed into a solution of a soluble silver salt in order to allow the silver salt to be absorbed into the layer. The titanium dioxide must, regardless of the preparation method, be dark adapted by storing it in a dark place at least one day at room temperature (about 10° C. to about 40° C.) or at an elevated temperature (about 40° C. to about 100° C.) before the titanium dioxide is brought into contact with the soluble silver salt. In addition, all of the above steps must be conducted under a safe light which does not irradiate radiation in the wavelength band having a wavelength higher than about 450 nm absorbed by the titanium dioxide.

The liquid used as a coating solvent is preferably a common solvent for the soluble silver salt, the soluble copper (II) salt and the hydrophilic binder. Specific examples of such common solvents include water and organic solvents generally having a high degree of polarity, such as N,N-dimethylformamide, 1,4-dioxane, acetone, methyl ethyl ketone, cyclohexanone, methyl acetate, ethyl acetate, methanol, ethanol, isopropanol, methyl Cellosolve, ethyl Cellosolve, methyl Cellosolve acetate, methylene chloride, dichloroethylene, chloroform, carbon tetrachloride, tetrahydrofuran, and the like. These solvents can be used either individually or in combination. The amount of the binding agent to the solvent can be varied over a wide range depending on the molecular weight of the binder polymer, the thickness desired, and the coating speed, but it is usually from about 3% to about 50% by weight based on the solvent.

The coating thereof onto the support can be carried out using any known coating procedure in the art, including immersion coating, air-knife coating, curtain coating, rod coating, spinner coating and whirler coating methods.

The light-sensitive layer coated on the support preferably has a thickness after drying of from about 0.5 μm to about 100 μm, more preferably from 1 μm to 20 μm.

The photographic material, after preparation, e.g., in the above manner, is exposed in an imagewise manner and developed by immersion into an aqueous solution containing a reducing agent (a chemical development solution).

Examples of suitable light-sources which can be used for the exposure include a tungsten lamp, a xenon lamp, a mercury lamp, a carbon arc, and the like. It is also possible to use X-rays or electron beams for the image-recording. The time required for the exposure can range from about 0.1 second to about 10 seconds when the exposure is effected using a 1 kw xenon lamp at a distance of 30 cm. Where another light source is used, the exposure may also be carried out within the above range by selecting other conditions appropriately.

Examples of suitable reducing agents which can be used in the chemical development solution include those which are generally used as a developer for silver halide photographic materials, such as L-ascorbic acid, paraformaldehyde, hydroquinone and derivatives thereof, p-aminophenol and derivatives thereof, etc., as well as those described in C. E. K. Mees and T. H. James, *The Theory of the Photographic Process,* 3rd Ed., Ch. 3, Macmillan Co., New York (1969); and L. F. A. Mason, *Photographic Processing Chemistry, pp.* 16–30, Oxford Press, London (1966). The reducing agents can be used either individually or in combination. Specific examples of useful hydroquinone derivatives include 2-methylhydroquinone, 2-ethylhydroquinone, 2-phenylhydroquinone, 2-chlorohydroquinone, pyrogallol and catechol; and specific examples of useful p-aminophenol derivatives include 4-(methylamino)-phenol hemisulfate, 4-(ethylamino)phenol hydrochloride, 4-(benzylamino)phenol hydrochloride, 4-(diethylamino)phenol hydrochloride and p-aminophenol sulfate.

In addition to these reducing agents, the chemical development solution can contain antioxidants and anti-foggants as well as amines or alkaline agents in order to improve the development activity. Particularly preferred formulations for the chemical developement solution of the invention are described below:

(1) Chemical development solutions using L-ascorbic acid as a reducing agent:

A solution containing L-ascorbic acid alone can be used. The development activity of the solution can be improved by the addition of an amine. The amount of the amine preferably ranges from about 1 mol to about 0.5 mol per mol of the ascorbic acid. It has been found that the density of the copper image may be greatly decreased if an excess of an amine is used therein. Examples of useful amines include those described in U.S. Pat. No. 3,512,972; including morpholine, hydroxyamines, such as diethanolamine, triethanolamine, etc., aliphatic amines, such as hexamethylenetetramine, cyclohexylamine, dodecylamine, etc., and aromatic amines, such as aniline, naphthylamine and derivatives thereof. The amount of L-ascorbic acid to be used is preferably from about 3 g to about 30 g per 100 ml of water.

When the light-sensitive material of the invention is developed using an aqueous solution containing L-ascorbic acid and amines alone, fog tends to be generated on the light-sensitive layer because of a deposition of red metallic copper. The generation of such a fog, however, can be prevented by adding a small amount of an anti-foggant to the developing solution. A suitable amount of anti-foggant preferably ranges from about 0.001 mol to about 0.5 mol per mol of L-ascorbic acid. Examples of suitable anti-foggants include alkali metal (e.g., lithium, sodium, potassium, etc.) or ammonium thiosulfates, alkali metal (e.g., lithium, sodium, potassium, etc.) or ammonium bromides, alkali metal (e.g., lithium, sodium, potassium, etc.) or ammonium iodides, thiourea, N-bromosuccinimide, nitrobenzoimidazoles as described in U.S. Pat. No. 2,496,940 and 2,656,271; mercaptobenzimidazole, 5-methylbenzotriazole, benzotriazole, 1-phenyl-5-mercaptotetrazole, and the like. It has also been found that these anti-foggants are not only capable of preventing fog, but also effectively increase the optical density of the copper image.

(2) Chemical development solutions using hydroquinone, p-aminophenol or derivatives thereof as a reducing agent:

The developing activity of a developer of this kind can be increased, in general, by adjusting the pH thereof to from about 10 to about 13 by the addition of an alkali agent, such as the hydroxides, carbonates, phosphates or tetrahydroborates of alkali metals (e.g., lithium, sodium, potassium, etc.) or ammonia. In order to prevent aerial oxidation of the reducing agent, stabilizers, such as sulfites, bisulfites, hydroxylamine hydrochloride, formaldehydesulfite adducts, etc., may preferably added thereto. The reducing agent is preferably used in an amount of from about 1 g to about 10 g per 10 ml of water.

(3) Chemical development solutions using formaldehyde or paraformaldehyde as a reducing agent:

It is also preferable to adjust the pH of this kind of developer to from about 11 to about 13 by adding an alkali agent as described in (2) above. It is desirable to additionally incorporate an anti-foggant as described in (2) above since developers of this kind tend to produce a dense fog. The amount of anti-foggant used is preferably from about 0.001 to about 0.1 part by weight, per part by weight of formaldehyde or paraformaldehyde. Formaldehyde or paraformaldehyde is generally used in an amount of from about 5 g to about 30 g per 100 ml of water.

The development of the light-sensitive material of the invention is generally effected at a temperature of from about 30° C. to about 70° C., preferably from 40° C. to 50° C. The developed photographic material of the invention can, after being washed and dried, be stored as a permanent image. No fixing is required because hardly any visible image is generated by means of exposure.

The invention is further illustrated by reference to the following examples, wherein all parts, percentages, ratios and the like are by weight unless otherwise indicated.

EXAMPLE 1

To 80 parts of N,N-dimethylformamide was added with stirring for one minute. 7.5 parts of powdered titanium dioxide (rutile type) for dispersion, and a solution of 0.03 part of silver nitrate in 20 parts of N,N-dimethylformamide was added thereto and the mixture was stirred for 30 minutes. To this mixture were added and dissolved in succession 1.5 parts of copper (II) nitrate and 7.5 parts of acetyl cellulose (degree of acetylation: 55%, average polymerization degree: 180). The resulting mixture was coated on a poly(ethylene terephthalate) film (support) having a thickness of 100 μm using a rod coater and dried for 1 hour at 50° C. to provide a photographic material. The light-sensitive layer coated on the support had a dry thickness of 8 μm and a silver nitrate content of about 0.02 g (as metallic silver) per $m^2$ of the material, the content being calculated from the area coated by the above mixture. The light-sensitive material was almost colorless.

The light-sensitive material was then closely contacted with an original and imagewise exposed through the original to light from a 1 kw xenon lamp at a distance of 30 cm for one second. A very thin yellowish brown image was formed in the exposed area. The material was then immersed in a developer having the following composition:

| | parts |
|---|---|
| Water | 100 |
| L-Ascorbic Acid | 10 |
| Morpholine | 4.8 |
| Sodium Thiosulfate | 0.2 |

for 30 seconds at 45° C. The color of the exposed area turned black, giving an image having a reflection density of 0.8 and a fog (or reflection density at the unexposed area) of 0.1. The thus-obtained image showed no color discoloration when the material was exposed to sunlight for a day after washing and drying.

EXAMPLES 2-3

The procedure of Example 1 was repeated, except that 0.08 or 0.01 part of silver nitrate was used, respectively, instead of the 0.03 part used in Example 1. The results obtained are shown in the following table.

| Example No. | Amount of Silver Nitrate (parts) | Image Density | Fog Density |
|---|---|---|---|
| 2 | 0.08 | 1.5 | 0.3 |
| 3 | 0.01 | 0.4 | 0.05 |

EXAMPLE 4

The procedure of Example 1 was repeated, except that titanium dioxide of an anatase type was used instead of that of a rutile type and the exposure was effected for 5 seconds. A black image having an image density of 0.7 and a fog density of 0.1 was obtained.

EXAMPLE 5

The procedure of Example 1 was repeated, except that 0.05 part of silver citrate was used instead of the 0.03 part of silver nitrate. A black image having an image density of 0.7 and a fog density of 0.1 was obtained.

EXAMPLES 6-10

The procedure of Example 1 was repeated, except that 1.5 parts of the copper (II) salts shown below were used, respectively, instead of the 1.5 parts of copper (II) nitrate. Black images having the image and fog densities shown below were obtained.

| Example | Copper (II) Salt | Image Density | Fog Density |
|---|---|---|---|
| 6 | Copper sulfate | 0.5 | 0.1 |
| 7 | Copper acetate | 0.6 | 0.15 |
| 8 | Copper caproate | 0.6 | 0.15 |
| 9 | Copper citrate | 0.4 | 0.15 |
| 10 | Copper benzoate | 0.4 | 0.1 |

EXAMPLE 11

The procedure of Example 1 was repeated, except that 4.5 parts of acetyl cellulose and 3 parts of poly(vinyl pyrrolidone) having a mean molecular weight of about 20,000 were used instead of the 7.5 parts of acetyl cellulose. A black image having an image density of 0.9 and a fog density of 0.15 was obtained.

EXAMPLE 12

To 50 parts of water was added with stirring 7.5 parts of powdered titanium dioxide (rutile type) for dispersion, and a solution of 0.1 parts of silver nitrate in 20 ml of water was added thereto and the mixture was stirred for 30 minutes. To this mixture were added in succession 1.5 parts of copper nitrate and 25 parts of a 20% aqueous solution of gelatin. After stirring the mixture for 1 hour, 1 part of a 10% aqueous solution of formaldehyde was added thereto. The resulting mixture was coated on a poly(ethylene terephthalate) film having a thickness of 100 μm using a rod coater and the coating was dried for 2 hours at 40° C. to produce a photographic material. The light-sensitive layer had a dry thickness of 5 μm.

The photographic material was exposed and developed in the same manner as in Example 1. A black image having an image density of 0.8 and a fog density of 0.02 was obtained.

EXAMPLES 13-15

The photographic material in Example 1 was exposed in the same manner in Example 1 and developed using the developers shown below for 30 seconds at 45° C. Black images having the image and fog densities shown below were obtained. (The images in Examples 13 and 14 were accompanied with a red fog.)

| Example | Developer | (parts) | Image Density | Fog Density |
|---|---|---|---|---|
| 13 | Water | 100 | 0.4 | 0.2 |
| | L-Ascorbic acid | 10 | | |
| 14 | Water | 100 | 0.7 | 0.3 |
| | L-Ascorbic acid | 10 | | |
| | Morpholine | 4.8 | | |
| 15 | Water | 100 | 0.3 | 0.05 |
| | L-Ascorbic acid | 10 | | |
| | Morpholine | 5.1 | | |
| | Sodium thiosulfate | 0.2 | | |

It can be understood from a comparison of the results obtained in Examples 13 and 14 that the density of the image can be increased by the addition of morpholine (less than an equimolar amount to the amount of L-ascorbic acid), and from a comparison of the results obtained in Examples 1 and 14 that the fog density can be markedly reduced and the density and contrast of the image can be improved by the addition of a small amount of sodium thiosulfate.

It can also be understood from a comparison of the results obtained in Examples 1 and 15 that the use of only a small excess, on a molar basis, of morpholine to L-ascorbic acid may result in a marked decrease in the image density.

EXAMPLES 16-20

Example 1 was repeated, except that the additives shown below were used instead of sodium thiosulfate in the developing solution. The results obtained are also shown in the following table.

| Example | Additive | (parts) | Image Density | Fog Density |
|---|---|---|---|---|
| 16 | Ammonium thiosulfate | 0.2 | 0.8 | 0.1 |
| 17 | Thiourea | 0.5 | 0.7 | 0.1 |
| 18 | Potassium iodide | 0.1 | 0.7 | 0.15 |
| 19 | Benzotriazole | 0.05 | 0.5 | 0.1 |
| 20 | N-Bromosuccinimide | 0.1 | 0.7 | 0.1 |

It can be seen from the above results that the additives contribute to the prevention of fog and the promotion of development (or improvement in contrast) similar to that achieved with sodium thiosulfate.

EXAMPLES 21-24

The procedure of Example 1 was repeated, except that 0.95 mol of the amines shown below were used per mole of L-ascorbic acid, instead of morpholine in the developing solution. Black images having the image and fog densities shown below were obtained.

| Example | Amine | Image Density | Fog Density |
|---|---|---|---|
| 21 | Diethanolamine | 0.85 | 0.1 |
| 22 | Triethanolamine | 0.8 | 0.1 |
| 23 | Cyclohexylamine | 0.8 | 0.1 |
| 24 | Hexamethylenetetramine | 0.8 | 0.1 |

EXAMPLES 25–28

The procedure of Example 1 was repeated, except that the following aqueous solutions were used instead of the developing solution used in Example 1 and the development was effected for 60 seconds at 45° C. Black images having the image and fog densities shown below were obtained.

| Example | Developer | (parts) | Image Density | Fog Density |
|---|---|---|---|---|
| 25 | Water | 100 | 0.5 | 0.1 |
| | Hydroquinone | 4 | | |
| | Sodium hydroxide | 2 | | |
| | Sodium sulfite | 6 | | |
| | (pH 11.4) | | | |
| 26 | Water | 100 | 0.6 | 0.1 |
| | 4-(methylamino)phenol hemisulfate | 3 | | |
| | Sodium hydroxide | 2 | | |
| | Sodium sulfite | 6 | | |
| | (pH 11.0) | | | |
| 27 | Water | 100 | 1.3 | 0.6 |
| | Paraformaldehyde | 10 | | |
| | Potassium hydroxide | 10 | | |
| | (pH 12.8) | | | |
| 28 | Water | 100 | 0.7 | 0.2 |
| | Paraformaldehyde | 10 | | |
| | Potassium hydroxide | 10 | | |
| | Sodium thiosulfate | 0.1 | | |
| | (pH 12.8) | | | |

It can be understood from a comparison of the results obtained in Examples 27 and 28 that an image having a relatively dense fog in the background thereof is obtained where sodium thiosulfate is not present as in Example 27, whereas an image having a reduced amount of fog and an increased contrast can be obtained where sodium thiosulfate is present as in Example 28.

EXAMPLES 29–31

The procedure of Example 28 was repeated, except that the amounts of the materials as shown below were used instead of the 0.1 part of sodium thiosulfate in the developing solution. Black images having the following image and fog densities were obtained.

| Example | Additive | (parts) | Image Density | Fog Density |
|---|---|---|---|---|
| 29 | Potassium bromide | 2.5 | 0.6 | 0.3 |
| 30 | Potassium iodide | 0.05 | 0.5 | 0.2 |
| 31 | Benzotriazole | 0.1 | 0.5 | 0.2 |

COMPARATIVE EXAMPLE 1

A sample was prepared in the same manner as in Example 1, except that no titanium dioxide was incorporated thereinto. The sample was exposed and immersed into the developer as described in Example 1, but no image was obtained.

COMPARATIVE EXAMPLE 2

A sample was prepared in the same manner as in Example 1, except that no silver nitrate was incorporated thereinto. The sample was exposed in the same manner as in Example 1, but no image (print out image) was observed. The sample was then immersed into the developing solution as described in Example 1, but no image was obtained.

COMPARATIVE EXAMPLE 3

A sample was prepared in the same manner as in Example 1, except that no copper (II) salt was incorporated thereinto. The sample was exposed in the same manner as in Example 1. A yellow print out image which had a lower optical density than that of the print out image in Example 1 was formed. The image was too low to be utilized as a final image in a similar manner to that in Example 1. The exposed sample was then immersed into the developing solution as described in Example 1. The yellow print out image became a little denser (reflection optical density in the visible wavelength region thereof was not more than 0.05 and the fog density was 0.00), but the image was still unsuitable for use as a final photographic image.

While the invention has been described in detail and with reference to specific embodiments thereof, it will be apparent to one skilled in the art that various changes and modifications can be made therein without departing from the spirit and scope thereof.

What is claimed is:

1. A photographic material comprising a support having thereon a light-sensitive layer containing (a) powdered titanium dixode, (b) a soluble silver salt soluble to an extent of at least about 10 mg in 100 ml of water or a polar organic solvent, (c) a soluble copper (II) salt soluble to an extent of at least about 0.1 g in 100 ml of water or a polar organic solvent and (d) a hydrophilic binder, wherein the amount of the soluble silver salt ranges from about 0.1 g to about 0.001 g, as metallic silver, per $m^2$ of said light-sentive layer.

2. The photographic material as claimed in claim 1, wherein said soluble silver salt is selected from the group consisting of silver nitrate, silver nitrite, silver chlorate, silver bormate, silver perchlorate, silver perbromate, silver (I) fluoride, silver sulfate, silver citrate, silver acetate, silver lactate and silver benzoate.

3. The photographic material as claimed in claim 1, wherein said soluble copper (II) salt is selected from the group consisting of copper nitrate, copper nitrite, copper sulfate, copper sulfite, copper chlorate, copper bromate, copper perchlorate, copper perbromate and a salt of copper (II) and an organic carboxylic acid represented by the following general formula:

$$R\text{—}(COOH)_n \qquad (I)$$

wherein R represents a hydrogen atom; a straight-chained, branched-chained or cyclic unsubstituted alkyl group having 1 to 17 carbon atoms which may contain 1 to 5 double bonds, or substituted derivatives thereof; a substituted or unsubstituted aryl group having 1 to 3 aromatic rings, in which the substituent may be one or more of an alkyl group having 1 to 5 carbon atoms, an alkoxyl group having 1 to 5 carbon atoms, an amino group, an aralkyl group having 7 to 20 carbon atoms and containing 1 to 2 aromatic rings, a halogen atom, an acetyl group, a hydroxyl group or a cyano group; and *n* represents an integer of 1 to 6.

4. The photographic material as claimed in claim 1, wherein the amount of said soluble copper (II) salt ranges from about 0.05 g to about 5 g, as metallic copper, per $m^2$ of said light-sensitive layer.

5. The photographic material as claimed in claim 1, wherein the amount of said powdered titanium dioxide ranges from about 0.5 g to about 50 g per $m^2$ of said light-sensitive layer.

6. The photographic material as claimed in claim 1, wherein said double silver salt is selected from the group consisting of silver nitrate and silver citrate, said soluble copper (II) salt is selected from the group consisting of copper nitrate and copper sulfate, and the amount of said soluble silver salt ranges from about 0.1 g to about 0.005 g, as metallic silver, per $m^2$ of said light-sensitive layer.

7. A method of forming an image comprising exposing the photographic material as claimed in claim 1 to actinic light in an imagewise manner, and developing a copper image by immersing the exposed photographic material into an aqueous solution containing a reducing agent to reduce the copper (II) salt.

8. The method of forming an image as claimed in claim 7, wherein said reducing agent is selected from the group consisting of L-ascorbic acid, formaldehyde, paraformaldehyde, hydroquinone, 2-methylhydroquinone, 2-ethylhydroquinone, 2-phenylhydroquinone, 2-chlorohydroquinone, pyrogallol, catechol, p-aminophenol, 4-(methylamino)phenol, 4-(ethylamino)phenol, 4-(benzylamino)phenol, 4-(dimethylamino)-phenol and 4-(diethylamino)phenol.

9. The method of forming an image as claimed in claim 7, wherein said aqueous solution containing said reducing agent is an aqueous solution containing L-ascorbic acid and said aqueous solution additionally contains an amine in an amount of about 1 mol to about 0.5 mol of the amine per mol of said L-ascorbic acid.

10. The method of forming an image as claimed in claim 9, wherein said aqueous solution additionally contains at least one compound selected from the group consisting of sodium thiosulfate, potassium thiosulfate, ammonium thiosulfate, thiourea, potassium iodide, sodium iodide, ammonium iodide, potassium bromide, sodium bromide, ammonium bromide, benzotriazole, 5-methylbenzotriazole, 1-phenyl-5-mercaptotetrazole, nitrobenzimidazoles, mercaptobenzimidazole and N-bromosuccinimide in an amount of from about 0.001 mol to about 0.5 mol of said compound per mol of said L-ascorbic acid.

11. The method of forming an image as claimed in claim 7, wherein said aqueous solution containing said reducing agent contains at least one compound selected from the group consisting of hydroquinone, 2-methylhydroquinone, 2-ethylhydroquinone, 2-phenylhydroquinone, 2-chlorohydroquinone, pyrogallol, catechol, p-aminophenol, 4-(methylamino)-phenol, 4-(ethylamino)phenol, 4-(benzylamino)phenol, 4-(dimethylamino)phenol and 4-(diethylamino)phenol, and has a pH of from about 10 to about 13.

12. The method of forming an image as claimed in claim 7, wherein said aqueous solution containing said reducing agent contains formaldehyde or paraformaldehyde, and said aqueous solution additionally contains at least one compound selected from the group consisting of sodium thiosulfate, ammonium thiosulfate, potassium iodide, sodium iodide, ammonium iodide, potassium bromide, sodium bromide, ammonium bromide, benzotriazole, 5-methylbenzotriazole, 1-phenyl-5-mercaptotetrazole, nitrobenzimidazoles, mercaptobenzimidazole and N-bromosuccinimide, in an amount of from about 0.001 to about 0.1 part by weight of said compound per part by weight of formaldehyde or paraformaldehyde and the pH of said solution is from about 11 to about 13.

13. The method of forming an image as claimed in claim 7, wherein said aqueous solution containing said reducing agent has a temperature ranging from about 30° C. to about 70° C.

* * * * *